US008783811B2

(12) United States Patent
Nitta et al.

(10) Patent No.: US 8,783,811 B2
(45) Date of Patent: Jul. 22, 2014

(54) PRINTING APPARATUS

(75) Inventors: Masaki Nitta, Yokohama (JP); Satoshi Hayashi, Yokohama (JP); Taku Yokozawa, Yokohama (JP); Hiroaki Shirakawa, Kawasaki (JP); Yuhei Oikawa, Yokohama (JP); Yosuke Ishii, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 41 days.

(21) Appl. No.: 13/557,069

(22) Filed: Jul. 24, 2012

(65) Prior Publication Data

US 2013/0027456 A1 Jan. 31, 2013

(30) Foreign Application Priority Data

Jul. 29, 2011 (JP) ..... 2011-166760

(51) Int. Cl.

| | |
|---|---|
| ***B41J 29/38*** | (2006.01) |
| ***B41J 2/21*** | (2006.01) |
| ***B41J 11/00*** | (2006.01) |
| ***B41J 2/045*** | (2006.01) |

(52) U.S. Cl.

CPC ..... *B41J 11/002* (2013.01); *B41J 2/2132* (2013.01); *B41J 2/04515* (2013.01); *B41J 2/0458* (2013.01); *B41J 2/04563* (2013.01); *B41J 2/04546* (2013.01); *B41J 2/04513* (2013.01)

USPC ..... 347/14; 347/9; 347/19

(58) Field of Classification Search

CPC ..... B41J 29/38

See application file for complete search history.

(56) References Cited

U.S. PATENT DOCUMENTS

| | | | | |
|---|---|---|---|---|
| 7,634,209 | B2 * | 12/2009 | Tanaka | 399/69 |
| 7,758,136 | B2 * | 7/2010 | Kachi | 347/6 |
| 2010/0329720 | A1 * | 12/2010 | Otsuka | 399/69 |
| 2011/0050794 | A1 * | 3/2011 | Koike et al. | 347/22 |
| 2011/0109682 | A1 * | 5/2011 | Kitai | 347/16 |
| 2012/0098882 | A1 * | 4/2012 | Onishi et al. | 347/18 |

FOREIGN PATENT DOCUMENTS

JP 3-151239 A 6/1991

* cited by examiner

*Primary Examiner* — Manish S Shah
*Assistant Examiner* — Jeremy Delozier
(74) *Attorney, Agent, or Firm* — Canon U.S.A., Inc. IP Division

(57) ABSTRACT

A printing apparatus, which includes a heating unit for heating a recording medium during printing, determines a pass number for multi-pass printing based on acquired information relating to the duty in each of a plurality of regions in one band of print region. The printing apparatus sets an amount of heat of the heating unit based on the acquired information.

11 Claims, 7 Drawing Sheets

PRINTING APPARATUS

BACKGROUND OF THE INVENTION

1. Field of the Invention

The present invention relates to a printing apparatus for printing an image by discharging ink on a sheet.

2. Description of the Related Art

Japanese Patent Application Laid-Open No. 3-151239 discusses an inkjet printing apparatus in which a heater for drying the moisture in ink applied onto a sheet is mounted. The heater is controlled so that the sheet has an optimum surface temperature according to the image recording duty (hereinafter, "duty"), i.e., the amount of ink applied per unit area of the sheet.

When an image region having a low duty that is easily dry and an image region having a high duty that is easily dried are intermingled with each other, if temperature control that is optimal for the low duty portion is performed, it is impossible to sufficiently dry the high duty portion. Conversely, if temperature control that is optimal for the high duty portion is performed, the low duty portion is excessively heated, so that the sheet can deform or degrade.

Japanese Patent Application Laid-Open No. 3-151239 discusses a technique in response to the problem in which the apparatus has a plurality of heaters in divided regions to control the respective heaters based on the duty, thereby the temperature is controlled for each region.

However, in the apparatus discussed in Japanese Patent Application Laid-Open No. 3-151239, when the temperature setting of a given heater is greatly different from the temperature setting for an adjacent heater, it is difficult to achieve a desired temperature because the portion near the edge of the heater is affected by the adjacent heater. Consequently, the above-described problem cannot be resolved.

SUMMARY OF THE INVENTION

An aspect of the present invention is directed to printing a high quality image by creating the optimum dried state with a simple configuration.

According to an aspect of the present invention, a printing apparatus includes a printing unit configured to print an image by applying ink on a recording medium, a heating unit configured to heat the recording medium during printing, an acquisition unit configured to acquire information relating to duty in each of a plurality of regions in one band of print regions, and a determination unit configured to determine a number of print passes based on the information acquired by the acquisition unit, wherein multi-pass printing is performed based on the number of print passes determined by the determination unit.

According to another aspect of the present invention, a printing apparatus includes a printing unit configured to print an image by applying ink on a recording medium, a heating unit configured to heat the recording medium during printing, an acquisition unit configured to acquire a maximum duty among a plurality of regions included in one band of print regions, and a setting unit configured to set an amount of heat of the heating unit so that a surface temperature of the recording medium is a temperature in accordance with the maximum duty.

According to the present invention, even for an image in which a low duty region and a high duty region are intermingled with each other, a high quality image can be formed by creating the optimum dried state even with a simple heater configuration.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
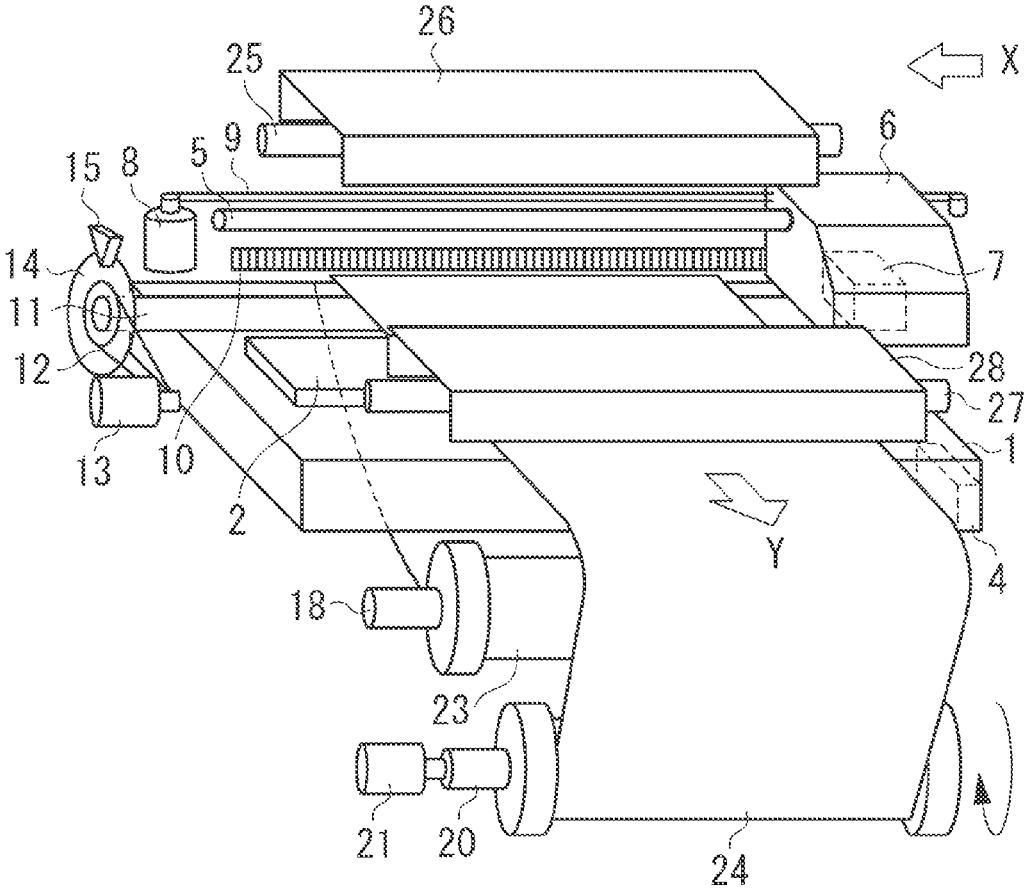
FIG. 1 is a perspective view illustrating a configuration of the main parts of an inkjet printing apparatus.
Figure 2:
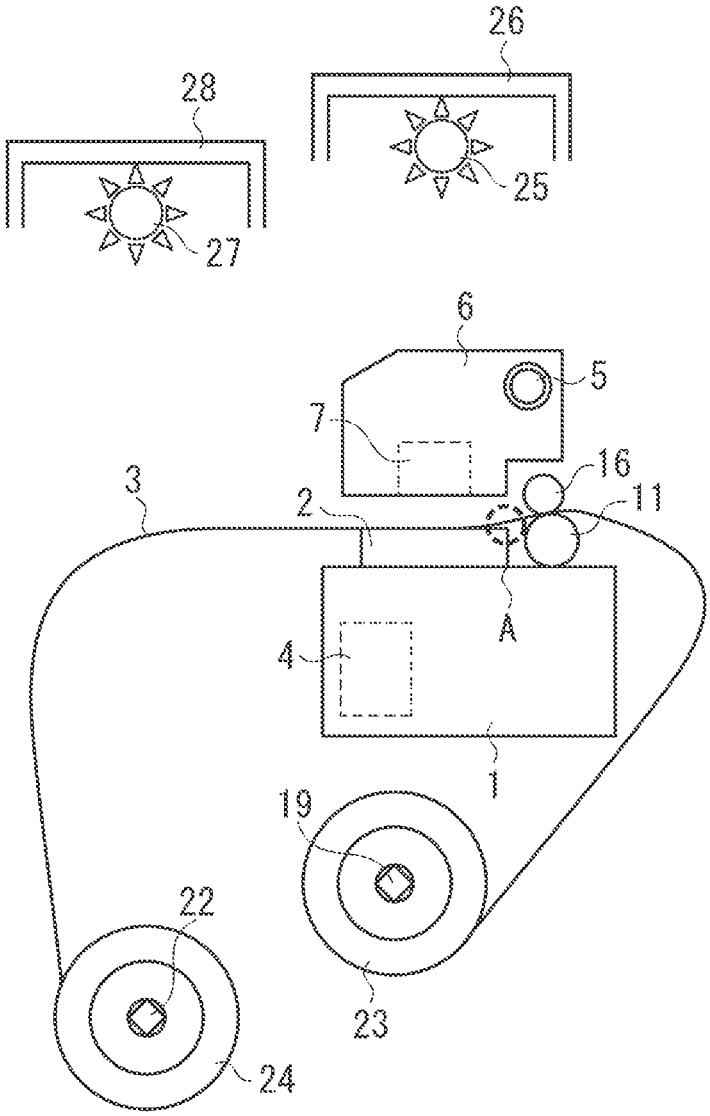
FIG. 2 is a side view illustrating a configuration of the main parts of an inkjet printing apparatus.

FIG. 1 is a perspective view illustrating a configuration of the main parts of an inkjet printing apparatus according to an exemplary embodiment, and FIG. 2 is a side view thereof. Basically, the apparatus is configured from a printing unit, a recording medium conveyance unit, a drying unit, and a control unit.

An example of the recording medium that is used by the apparatus according to the present exemplary embodiment is a recording medium that does not have a reception layer of vinyl chloride or the like that repels moisture (hereinafter, "recording medium free from a reception layer"). However, a common recording medium that does have a reception layer can also be used. An example of the used ink is an ink that includes a large amount of polymer emulsion which has characteristics such that the moisture in the ink evaporates when heat is applied to the ink on the recording medium, then ink becomes soft, and the ink forms a film. Due to the ink forming a film on the recording medium, the weatherability, water resistance, and wear resistance of the image can be improved.

The printing unit forms an image based on a serial printing method by repeatedly reciprocally scanning in a main scanning direction (X direction) a print head 7 with a carriage 6 with respect to a recording medium conveyed in steps in a sub-scanning direction (Y direction) on a platen 2.

The platen 2 is mounted on a housing 1. A suction member 4 for making the recording medium 3 stick to the platen 2 is provided in the housing 1. The carriage 6 that reciprocally moves in the main scanning direction is supported on a main rail 5 arranged in the longitudinal direction of the housing 1. The carriage 6 is mounted with an inkjet type print head 7. Examples of the energy generating element for discharging ink from the print head nozzles include a heating element, a piezo element, an electrostatic element, a MEMS element and the like. Any of these may be used.

A carriage motor 8 is a drive source for moving the carriage 6 in the main scanning direction. The rotational drive force from the carriage motor 8 is transmitted to the carriage 6 via a belt 9. The position of the carriage 6 in the main scanning direction is detected and monitored by a linear encoder. The linear encoder is configured from a linear encoder pattern 10 attached to the housing 1, and a (not illustrated) reading unit that is mounted on the carriage 6 for optically, magnetically, or mechanically reading the linear encoder pattern 10. The printing unit is configured as described above.

The recording medium conveyance unit handles recording medium feeding, recording medium conveyance in the printing unit, and recording medium collection. A long continuous recording medium, which is a recording medium, is fed as a roll 23 wound in a roll shape to the periphery of a spool 18. The spool 18 has a torque limiter 19 for applying a braking force (back tension) on the recording medium 3. The recording medium drawn from the roll 23 is fed from the front to the rear of the apparatus beneath the printing unit (housing 1).

The recording medium 3 fed beneath the housing 1 goes around the housing 1, and is fed from the rear to the front onto the platen 2. The recording medium 3 on the platen 2 is conveyed in a sub-scanning direction (direction of the arrow in FIG. 1) that is orthogonal to the main scanning direction of the carriage 6. The conveyance operation is performed by a drive mechanism configured from a conveyance roller 11, a pinch roller 16, a belt 12, and a conveyance motor 13. The drive state of the conveyance roller 11 (amount of rotation and rate of rotation) is detected and monitored by a rotary encoder. The rotary encoder is configured from a circumferential encoder pattern 14 that rotates with the conveyance roller 11, and a (not illustrated) reading unit 15 that optically, magnetically, or mechanically reads the circumferential encoder pattern 14.

An image is printed on the recording medium by the print head 7 in the printing unit, and the printed recording medium is taken up for collection by a spool 20. The recording medium is wound in a roll shape on the periphery of the spool 20 to form a roll 24. The spool 20 is rotated by a take-up motor 21, and has a torque limiter 22 for applying take-up tension on the recording medium 3.

The drying unit is a unit for irradiating energy for quickly drying the ink applied on the recording medium when using a recording medium free from a reception layer. The drying unit has a first heater 25 that is provided over (directly above) the platen 2 and that is higher than the carriage 6, and a second heater 27 that is provided downstream from the platen 2 in the conveyance direction and that is higher than the carriage 6. The first heater 25 and the second heater 27 are covered by a first heater cover 26 and a second heater cover 28, respectively. Each of these heater covers has a function for directing the heat (infrared rays and ultraviolet rays) from the heater onto the recording medium surface by reflecting the heat with a mirror surface on the cover inner side, and a function for physically protecting the heater.

The first heater 25, which is positioned directly above the platen 2, irradiates heat energy onto a region where the print head 7 reciprocally moves. When the ink discharged from the print head 7 impacts on the print face, the carriage 6 then immediately moves away, so that the applied ink is exposed to the heat energy irradiated from the first heater 25. Consequently, evaporation drying of the moisture in the ink is promoted immediately after printing.

The recording medium region on which the ink having a reduced moisture content due to the heat energy from the first heater 25 is applied is conveyed to the downstream side by step feeding. At the downstream side, the second heater 27 irradiates heat energy. The second heater 27 has a greater power than the first heater 25. A special component in the ink is dissolved by this high-temperature heat energy, and coats a color material in the ink. Consequently, the ink is strongly fixed even to the recording medium free from a receptive layer, so that an image with high weatherability is formed.

Figure 3:
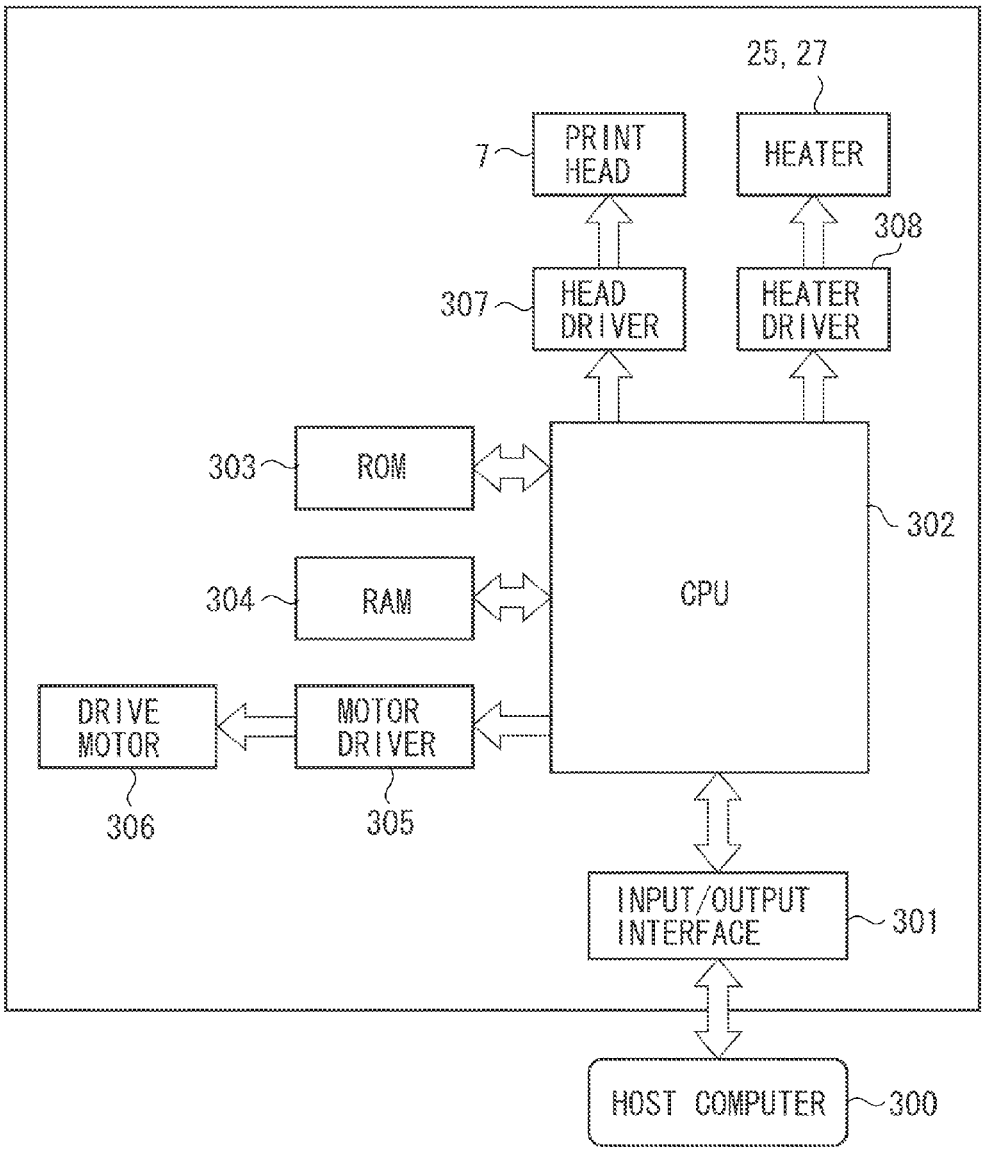
FIG. 3 is a system block diagram of a control unit.

FIG. 3 is a system block diagram of a control unit that controls the printing apparatus. The main part in the control unit is a computer section configured from a central processing unit (CPU) 302, a read-only memory (ROM) 303, and a random access memory (RAM) 104. An input/output interface 301, which connects the CPU 302 and an external host computer 300, enables bidirectional communication based on a predetermined protocol. The drive of various drive motors 306 in the printing apparatus is controlled via a motor driver 305 based on commands from the CPU 302. The print head 7 is driven via a head driver 307 based on commands from the CPU 302. Heaters 25 and 27 are controlled via a heater driver 308 based on commands from the CPU 302.

The operating procedure for forming the image on the recording medium by multi-pass printing based on control by the control unit will now be described.

When not performing a printing operation, the carriage 6 on which the print head 7 is mounted waits at a home position (position in FIG. 1). When performing a printing operation, before starting the operation, the carriage 6 waits until the recording medium surface is heated by the heaters 25 and 27 to a standard temperature (60° C.).

The used ink has characteristics to form a film at, for example, 55° C. The standard temperature of 60° C. is determined according to the above temperature, and thus the heaters are controlled so that the surface temperature of the recording medium before printing is 60° C. When the ink impacts the recording medium, the surface temperature of the recording medium decreases due to the heat of vaporization. Thus, it is desirable to increase the temperature in advance before printing while taking the above decrease into account so that the surface temperature of the recording medium is 60° C. when the ink impacts.

Next, while the carriage 6 is scanning in the forward direction (direction leaving the home position), the ink is applied on the surface of the recording medium from the print head 7 based on the image data, so that one band of the image is printed (X scan). The one band has a width that is the same as the length in the Y direction of the nozzle array included in the print head 7. However, when using only a restricted range of the nozzle array, the width of the used nozzle array range is the one band width.

When the printing of one band of image finishes, the conveyance roller 11 is rotated to feed the recording medium one step in the Y direction (Y scan). The width of one step feed changes based on the number of print passes in the multi-pass printing. If the number of print passes is 1 (1 pass), the width is the same as the length of the nozzle array in the print head. If the number of print passes is 2 (2 passes), the step feed width is ½ the length of the nozzle array in the print head. For 4 passes, the width is ¼ the length of the nozzle array. To generalize, the width of a step feed in the Y direction for N-number of recording passes is 1/N the length of the nozzle array. Therefore, the greater N is, the smaller the width of one feed step. The width of one band does not change even if the number of passes in multi-pass printing changes.

Next, while the carriage 6 is scanning in the backward direction (direction heading toward the home position), the next one pass of the image is printed (X scan). The recording medium is step-fed by just the feed width that is based on the number of passes in multi-pass printing in the Y direction. The printing of one image is completed by repeating the above scanning and step feeding, i.e., by a serial printing method. Further, multi-pass printing can also be performed by step feeding the recording medium a distance that is the same as the length of the nozzle array after repeating the same number of scans as the pass number.

Figure 4:
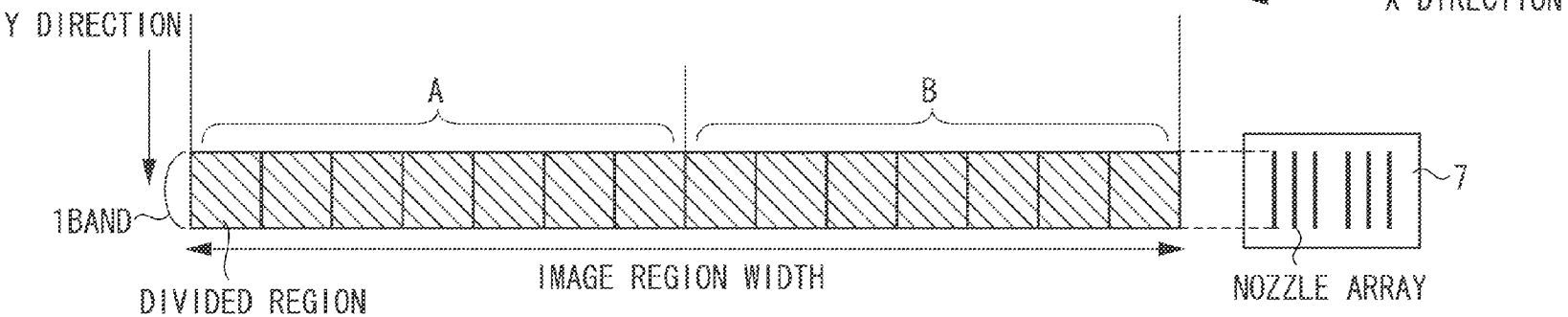
FIG. 4 illustrates a method for acquiring information relating to duty.

The method for acquiring duty-related information will now be described referring to FIG. 4. FIG. 4 illustrates an example of one band (region indicated by hatching) and divided regions in the band. The one band is the same size in the X direction as the printed image region width, and the same size in the Y direction as the length of the nozzle array of the print head 7. The one band is virtually divided into a plurality of small regions at equal interval. In this example, the one band is divided into 14 small regions. The size of one divided region is, for example, 1 inch in the X direction and 1 inch in the Y direction. The size of a divided region in the X direction roughly matches the period that would be expected when the recording medium is deformed into a periodic ripple-like shape due to excessive heating. The width of the one band and the number of divisions do not change even if the number of passes in multi-pass printing changes.

Information relating to the maximum duty and the minimum duty for each of the divided regions is acquired by acquiring a total duty of all the ink colors for each of the divided regions included in the one band. Based on the acquired information, the number of print passes is determined and the amount of heat for the heaters is set.

In the example illustrated in FIG. 4, in region A and region B included in the one band, the duty of the divided regions included in the respective regions is greatly different. The divided region having the minimum duty, which is 20%, is included in region A. The divided region having the maximum duty, which is 100%, is included in region B. Since these values are the duty per pass, for two-pass printing, the actual image density is doubled.

Figure 5:
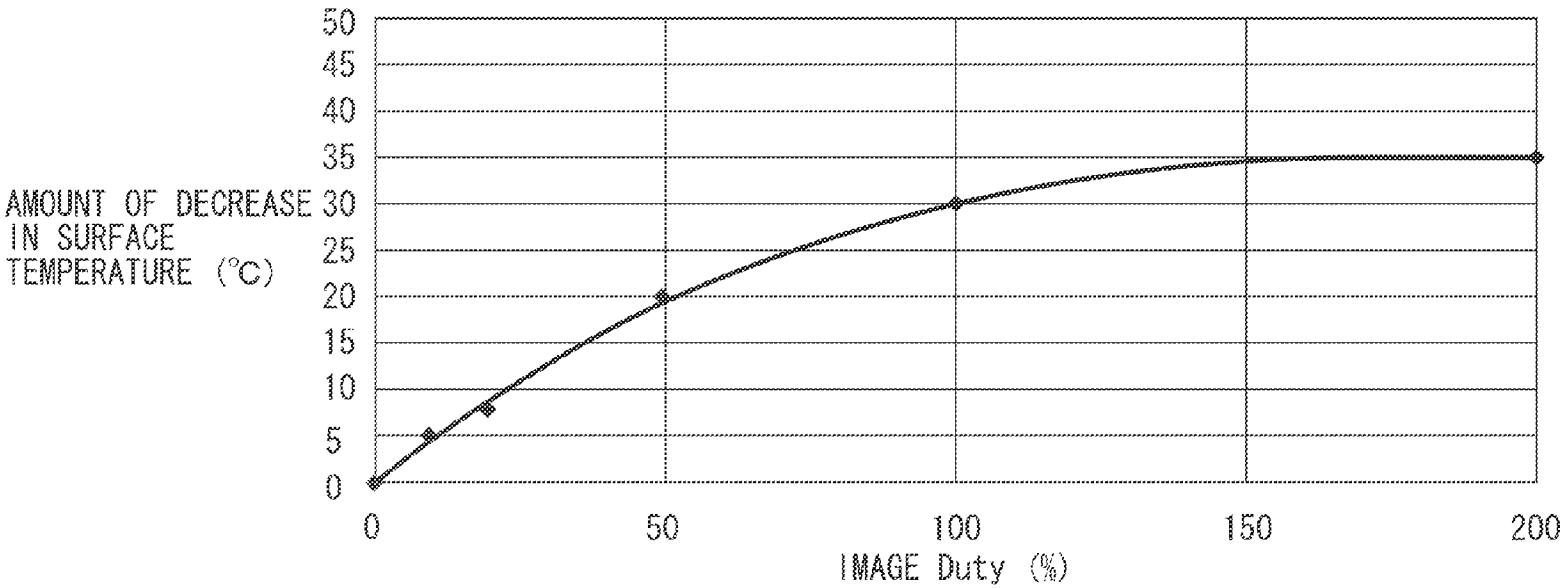
FIG. 5 is a graph illustrating a correspondence relationship between duty and amount of decrease in recording medium surface temperature.

FIG. 5 is a graph illustrating a correspondence relationship between the duty per pass and the amount of decrease in surface temperature of the recording medium. The greater the duty, the greater the amount of decrease in surface temperature of the recording medium after ink impact. Therefore, the surface temperature is increased before printing by that amount with reference to this graph. The graph is stored in a memory in the control unit in the form of a data table or a mathematical equation, which allows it to be referred to.

Figure 6:
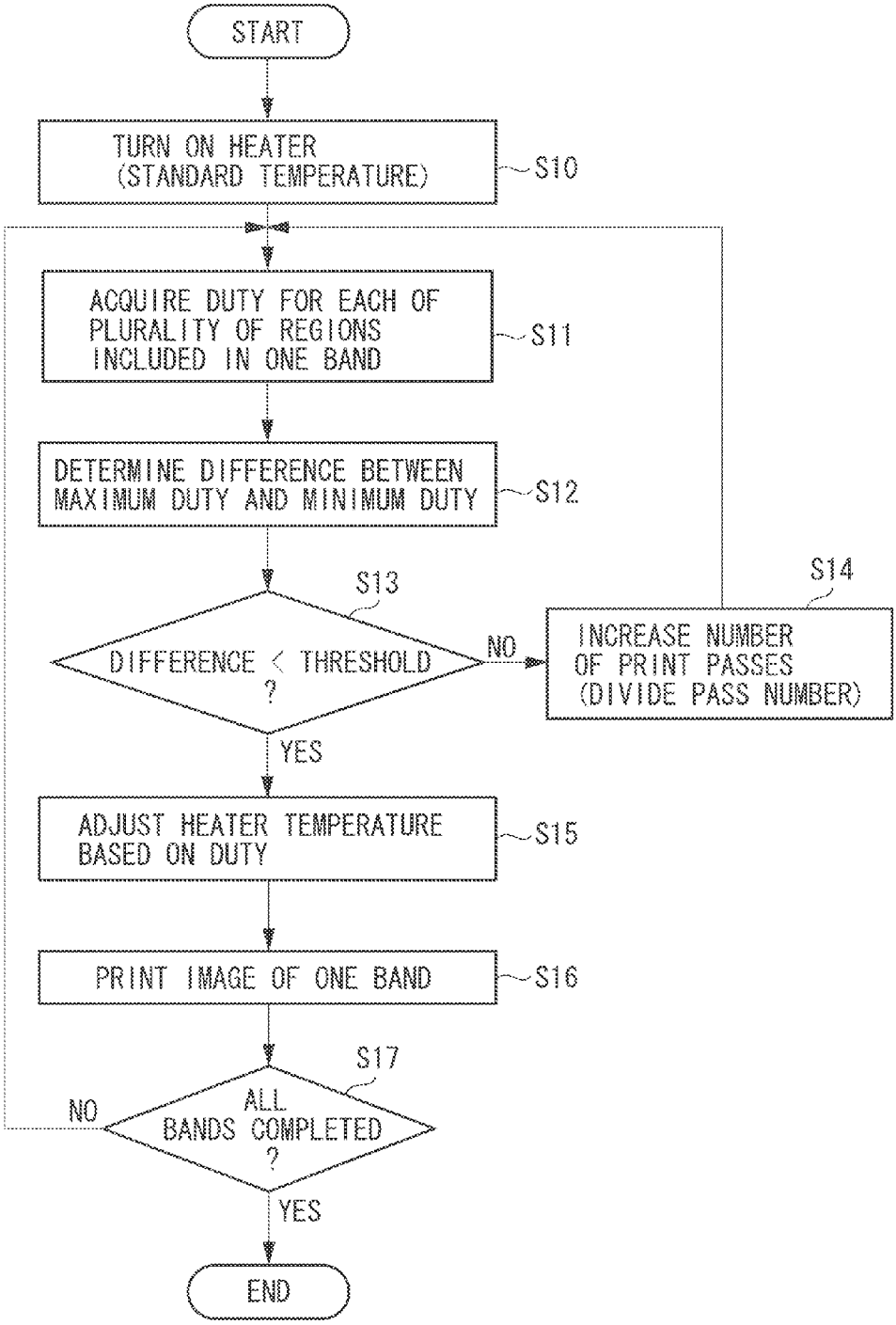
FIG. 6 is a flowchart illustrating an operation sequence.

FIG. 6 is a flowchart illustrating an operation sequence. In step S10, the heaters are turned on. The heater temperature is set so that the recording medium surface has a standard temperature (60° C.). Next, in step S11, information is acquired relating to image recording duty (image density) for each of the plurality of divided regions in one band of print regions.

In step S12, the difference between the maximum duty and the minimum duty among the plurality of divided regions included in one printing pass is determined.

In step S13, the determined difference is compared with a predetermined threshold (e.g., 50%). If it is determined that the determined difference is less than the threshold (YES in step S13), the processing proceeds to step S15. If it is determined that the determined difference is equal to or more than the threshold (NO in step S13), the processing proceeds to step S14.

In step S14, the number of print passes is increased by dividing the passes in the image printing. Then, the processing returns to step S11, and the processing is repeated.

More specifically, in step S14, the number of print passes that is repeated in order to complete an image for a predetermined region is increased by performing pass division. For example, if the number of print passes is two, the passes are divided so that there is four print passes. Subsequently, the number of passes increases to six, and then eight. The greater the number of passes, the narrower the step feeding width in the Y direction per one band of printing. Irrespective of the pass number, the one band regions do not change. The number of smaller regions that one band is divided into, i.e., the size of the divided small regions, is fixed, and does not depend on the number of passes. In contrast, the amount of ink applied in one scan, specifically, the image density formed by one scan, decreases the greater the number of passes becomes.

In the example illustrated in FIG. 4, the initial setting is set so that printing is performed in two passes. In this case, the maximum duty is 100%, the minimum duty is 20%, and the difference between them is 80%. Therefore, the number of print passes is increased from two to four. Since the image density for one scan is halved, mask data with a duty of 50% is applied on the image data whose image density is to be halved. Specifically, by dividing the two passes into four passes, the duty per pass is halved, so that the maximum duty decreases to 50% and the minimum duty decreases to 10%. The difference between these values is 40%, which is within the threshold of 50%. Once the difference has decreased below the threshold in this manner, the processing proceeds to step S15 without performing any further pass division. Thus, the control unit (determination unit) sets the number of print passes so that the difference between the maximum duty and the minimum duty is less than a threshold. In other words, the number of print passes is set so that the maximum difference in the image density of a plurality of divided regions is less than a predetermined threshold.

In step S15, the heater temperature is adjusted according to the maximum duty. The control unit (setting unit) sets the temperature setting of the heaters (heating unit) so that the surface temperature of the recording medium is a temperature corresponding to the maximum duty.

The temperature setting of the heaters is determined using the correspondence relationship illustrated in FIG. 5 so that the recording medium surface temperature after ink impact is 60° C. in the maximum duty divided region. In this example, since the maximum duty is 50%, the decrease in recording medium surface temperature is 20° C. Consequently, the heater temperature setting is changed so that the recording medium surface becomes 80° C. Basing the heating on the maximum duty means that heating exceeding 60° C. is performed on the regions other than the maximum duty, especially the minimum duty region. However, since the difference between the maximum and the minimum duties is decreased by the above-described optimization of the number of print passes, deformation and degradation of the recording medium due to excessive heating of the minimum duty region can be prevented.

In step S16, one band of image is printed based on the optimum number of print passes that has been set. In step S17, it is determined whether printing of all the bands for forming one image has been completed. If it is determined that the printing of all bands has been completed (YES in step S17), the processing is finished. If it is determined that the printing of all bands has not been completed (NO in step S17), the processing returns to step S11, and the same processing is repeated for the next one band.

In the above procedure, the processing loop of steps S13 and S14 is repeated to determine the number of print passes. However, the present invention is not limited to this. The number of print passes can also be determined in one calculation, by calculating the number of pass divisions so that the difference between the maximum duty and the minimum duty is less than 50%, for example. Further, the setting of the threshold at 50% is an example. The threshold may be set to a different value according to the various properties of the apparatus.

Figure 7:
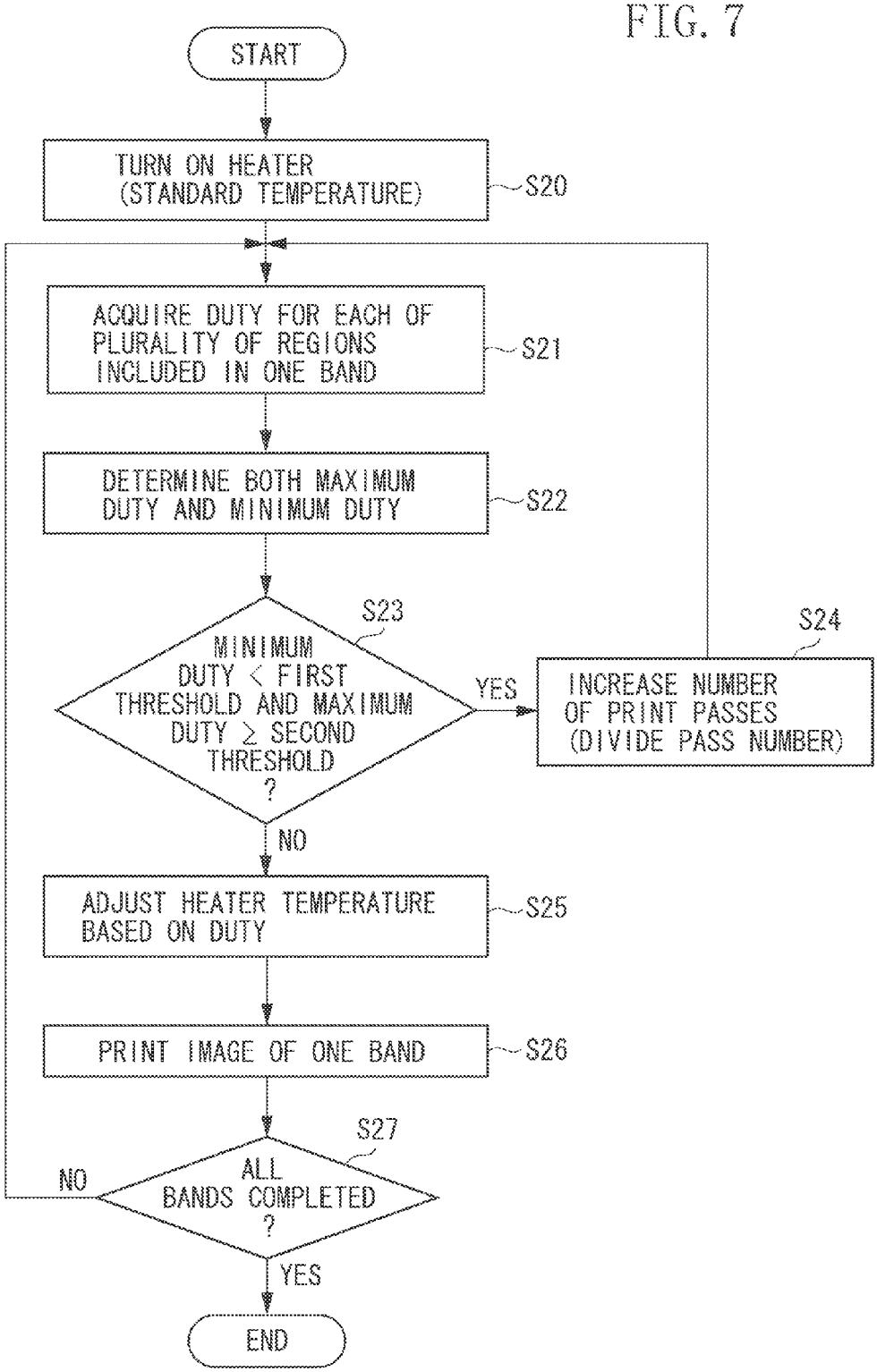
FIG. 7 is a flowchart illustrating an operation sequence according to another exemplary embodiment.

FIG. 7 is a flowchart illustrating an operation sequence according to another exemplary embodiment. The difference with FIG. 6 is the determination method illustrated in steps S22 and S23. In the other steps, steps S20, S21, and S24 to S27, exactly the same processing as steps S10, S11, and S14 to S17 is performed.

In step S22, the maximum duty and the minimum duty are each determined. In step S23, it is determined whether the minimum duty is less than a first threshold (50%) and whether the maximum duty is equal to or more than a second threshold (100%). If it is determined that the determination is a "YES" (YES in step S23), the processing proceeds to step S24, and the number of print passes is increased. The optimum number of print passes is obtained by repeating the above processing until the determination is a "NO".

Thus, the control unit (determination unit) sets the number of print passes so that the minimum duty is not less than a first threshold and the maximum duty is not equal to or greater than a second threshold. Further, the control unit (determination unit) sets the temperature setting of the heaters (heating unit) so that the surface temperature of the recording medium is a temperature corresponding to the maximum duty.

Based on the assumption that the printing apparatus is configured with means for heating the recording medium during printing, the above printing apparatus determines the pass number for multi-pass printing based on acquired information relating to the duty in each of a plurality of regions in one band of print regions. Consequently, even for an image in which a low duty region and a high duty region are intermingled with each other, a high quality image can be formed by creating the optimum dried state with a simple heater configuration.

Further, based on the assumption that the configuration includes means for heating the recording medium during printing, the printing apparatus acquires the maximum duty among the plurality of regions included in one band of print regions, and sets the amount of heat of the heating means so that the surface temperature of the recording medium is a temperature corresponding to the maximum duty. Consequently, even for an image in which a low duty region and a high duty region are intermingled with each other, a high quality image can be formed by creating the optimum dried state with a simple heater configuration.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-166760 filed Jul. 29, 2011, which is hereby incorporated by reference herein in its entirety.

What is claimed is:

1. A printing apparatus comprising:

a printing unit, having a carriage and a print head mounted on the carriage, configured to print an image by applying ink on a recording medium while repeating movement of the carriage to record one band of print region to perform multi-pass printing;

a heating unit configured to apply heat onto the recording medium during printing to dry the ink, wherein the heating unit is provided above an area where the carriage moves reciprocally, and applies the heat in the area;

an acquisition unit configured to acquire information relating to duty in each of a plurality of regions divided within one band of print region; and a determination unit configured to determine a number of print passes based on the information acquired by the acquisition unit, wherein the multi-pass printing is performed based on the number of print passes determined by the determination unit.

2. The printing apparatus according to claim 1, further comprising a setting unit configured to set an amount of heat of the heating unit based on the information acquired by the acquisition unit.

3. The printing apparatus according to claim 2, wherein the information is a difference between a maximum duty and a minimum duty among the plurality of regions in subject to one print pass, wherein the determination unit is configured to set the number of print passes so that the difference between the maximum duty and the minimum duty is less than a threshold, and wherein the setting unit is configured to set the heating unit so that a surface temperature of the recording medium becomes a temperature suitable for the maximum duty.

4. The printing apparatus according to claim 2, wherein the information is a maximum duty and a minimum duty among the plurality of regions subject to one print pass, wherein the determination unit is configured to set the number of print passes so that the minimum duty is greater than or equal to a first threshold and the maximum duty is less than a second threshold, and wherein the setting unit is configured to set the amount of heat of the heating unit so that a surface temperature of the recording medium becomes a temperature suitable for the maximum duty.

5. The printing apparatus according to claim 1, further comprising a second heater arranged downstream of the heating unit, wherein the second heater applies higher energy onto the recording medium than that of the heating unit.

6. The printing apparatus according to claim 1, wherein each of the plurality of regions is divided at equal intervals based on a period that would be expected when the recording medium is deformed into a periodic ripple-like shape due to excessive heating.

7. The printing apparatus according to claim 1, wherein the recording medium is a recording medium that does not have an ink reception layer, and wherein the ink includes polymer emulsion.

8. A printing apparatus comprising:

a printing unit, having a carriage and a print head mounted on the carriage, configured to print an image by applying ink on a recording medium while repeating movement of the carriage to record one band of print region;

a heating unit configured to apply heat onto the recording medium during printing to dry the ink, wherein the heating unit is provided above an area where the carriage moves reciprocally, and applies the heat in the area;

an acquisition unit configured to acquire a maximum duty among a plurality of regions divided within one band of print region; and a setting unit configured to set an amount of heat of the heating unit so that a surface temperature of the recording medium becomes a temperature suitable for the maximum duty.

9. The printing apparatus according to claim 8, further comprising a second heater arranged downstream of the heating unit, wherein the second heater applies higher energy onto the recording medium than that of the heating unit.

10. The printing apparatus according to claim 8, wherein each of the plurality of regions is divided at equal intervals based on a period that would be expected when the recording medium is deformed into a periodic ripple-like shape due to excessive heating.

11. The printing apparatus according to claim 8, wherein the recording medium is a recording medium that does not have an ink reception layer, and wherein the ink includes polymer emulsion.

* * * * *